US010624805B2

(12) United States Patent
Mahjoubi

(10) Patent No.: US 10,624,805 B2
(45) Date of Patent: Apr. 21, 2020

(54) PATIENT TRANSFER SYSTEM

(71) Applicant: Mike Mahjoubi, Encino, CA (US)

(72) Inventor: Mike Mahjoubi, Encino, CA (US)

( * ) Notice: Subject to any disclaimer, the term of this patent is extended or adjusted under 35 U.S.C. 154(b) by 0 days.

(21) Appl. No.: 15/956,734

(22) Filed: Apr. 18, 2018

(65) Prior Publication Data

US 2019/0125603 A1 May 2, 2019

Related U.S. Application Data

(60) Provisional application No. 62/486,988, filed on Apr. 19, 2017.

(51) Int. Cl.

| | |
|---|---|
| ***A61G 7/10*** | (2006.01) |
| ***A61G 7/08*** | (2006.01) |
| ***A61G 7/16*** | (2006.01) |
| ***A61G 7/07*** | (2006.01) |
| ***A61G 7/015*** | (2006.01) |
| ***A61G 5/00*** | (2006.01) |
| ***A61G 7/075*** | (2006.01) |

(52) U.S. Cl.

CPC ..... *A61G 7/1026* (2013.01); *A61G 5/006* (2013.01); *A61G 7/015* (2013.01); *A61G 7/07* (2013.01); *A61G 7/0755* (2013.01); *A61G 7/08* (2013.01); *A61G 7/1017* (2013.01); *A61G 7/1019* (2013.01); *A61G 7/1021* (2013.01); *A61G 7/1042* (2013.01); *A61G 7/1048* (2013.01); *A61G 7/1057* (2013.01); *A61G 7/16* (2013.01)

(58) Field of Classification Search

CPC .. A61G 7/1026; A61G 7/0755; A61G 7/1017; A61G 7/1021; A61G 5/006; A61G 7/015; A61G 7/1048; A61G 7/07; A61G 7/16; A61G 7/1042; A61G 7/1019; A61G 7/08; A61G 7/1057; B60P 3/38–39

See application file for complete search history.

(56) References Cited

U.S. PATENT DOCUMENTS

| | | | | |
|---|---|---|---|---|
| 5,020,169 | A * | 6/1991 | Hamada | A47C 17/84 5/10.2 |
| 6,295,702 | B1 * | 10/2001 | Bauer | A45C 13/1069 24/303 |
| 2004/0221388 | A1 * | 11/2004 | Votel | A61G 7/1015 5/81.1 HS |

(Continued)

*Primary Examiner* — Nicholas F Polito
*Assistant Examiner* — Myles A Throop
(74) *Attorney, Agent, or Firm* — Barry Choobin; Patent 360

(57) ABSTRACT

The embodiments herein provide a patient transfer system for transferring a patient form one surface to another with a single attendant/caretaker. The system comprises a main base with wheels, a column actuator for height adjustment and a patient resting surface. The patient resting surface comprises two surfaces made of a mattress and a sheet. During transfer of patient from one surface to another, the system is attached/locked to a firm surface like floor, wall or ceiling using mechanical attachment devices for providing stability. The sheet when pulled lengthwise is transformed into an almost hard surface. A frame with sheet carrying patient is moved horizontally or vertically for transferring the patient. The sheet is made out of radiolucent material to avoid any effects due to radiations during X-ray, CT scans, MRI etc. The system is also convertible into a wheelchair using actuators when needed.

17 Claims, 21 Drawing Sheets

(56) References Cited

U.S. PATENT DOCUMENTS

| | | | | |
|---|---|---|---|---|
| 2007/0124858 | A1* | 6/2007 | Ahlman | A61B 6/0442 5/81.1 R |
| 2014/0007353 | A1* | 1/2014 | Stryker | A61G 7/001 5/715 |
| 2018/0280219 | A1* | 10/2018 | Garrett | A61G 7/001 |

* cited by examiner

PATIENT TRANSFER SYSTEM

BACKGROUND

Technical Field

The embodiments herein are generally related to a field of patient transfer systems. The embodiments herein are particularly related to the patient transfer systems used for transporting a patient from a bed to a stretcher or vice versa. The embodiments herein are more particularly related to a patient transfer system to enable a single health care worker capability to move a patient from one surface to another without any assistance.

Description of the Related Art

Patients are transferred many times during their stay in hospitals for reasons such as moving to a new room, laboratory, X-Ray facility, Operation Theater and the like. Wheel chairs or stretchers are typically used for these purposes. In order to transfer a patient from a bed to a stretcher, currently several personnel are required to either physically lift the patient onto the stretcher or to move the patient laterally by pulling a sheet underneath him/her onto the stretcher. This procedure is time consuming, difficult, and ties up several personnel for several minutes. These health care/nursing/para medical personnel must leave other duties unattended at the time. This also increases the staff requirements of a hospital. This task frequently requires considerable strength and is occasionally a source of injury to the attendant. Many times it is difficult to move an injured patient by these procedures without causing discomfort, pain or injury.

Various types of stretchers have been proposed in the art for solving above mentioned difficulties. Some stretchers offer horizontal transfer of a patient from one flat surface to another. Other stretchers include pulling the patient up in the bed or rolling the patient from side to side. In some situations a crane/swing type of mechanism is employed for lifting/transferring patients from one bed to another. While considerable effort has gone into developing patient transfer systems, all the systems previously or so for developed have significant drawbacks. These drawbacks primarily relate to the significant difficulties encountered in set-up, operation, easy of handling for the attendant and convenience to the patient.

Hence, there is a need for an improved patient transfer system capable of transferring a patient with a help of a single attendant. There is also a need for a patient transfer system which uses a special sheet that is stretched to form a hard surface for easy patient transfer. Further, there is a need for a patient transfer system that gets attached/affixed and locked to the floor, wall, ceiling and the like to aid patient transfer by providing mechanical stability.

The above mentioned shortcomings, disadvantages and problems are addressed herein and which will be understood by reading and studying the following specification.

OBJECTIVES OF THE EMBODIMENTS HEREIN

The primary object of the embodiments herein is to provide an improved patient transfer system which is capable of transferring a patient with a help of a single attendant.

Another object of the embodiments herein is to provide a patient transfer system that uses a special sheet which is stretched to form a hard surface for easy patient transfer.

Yet another object of the embodiments herein is to provide a patient transfer system that gets attached/affixed and locked to the floor, wall, ceiling and the like to aid patient transfer by providing mechanical stability.

Yet another object of the embodiments herein is to provide a patient transfer system provided with two separate surfaces, one comprising of a mattress which is easily convertible into a chair and the other one which is a sheet that is stretched into a hard surface for transferring the patient horizontally.

Yet another object of the embodiments herein is to provide a patient transfer system that is easily convertible into a wheel chair when needed or on demand.

Yet another object of the embodiments herein is to provide patient transfer system with a floor attachment mechanism that is useful in several other applications such as lifting heavy objects, taking or putting parcels on the shelves and the like.

Yet another object of the embodiments herein is to provide a patient transfer system to enable a horizontal movement of the patient from the stretcher to any other surface or from the other surface to the stretcher.

Yet another object of the embodiments herein is to provide a patient transfer system to enable a vertical movement of the patient for lifting or bending down the patient.

Yet another object of the embodiments herein is to provide a patient transfer system comprising a sheet of radiolucent compatible material which has no interruption or any effects when used during X-ray, CT scan and the like.

Yet another object of the embodiments herein is to provide a patient transfer system that prevents bedsores and also enables patient movement to the sides using air bags installed inside the sheet.

These and other objects and advantages of the embodiments herein will become readily apparent from the following detailed description taken in conjunction with the accompanying drawings.

SUMMARY

These and other aspects of the embodiments herein will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

The various embodiments herein provide a patient transfer system. The system comprises a bed, a frame, a main base comprising a plurality of caster wheels. The plurality of caster wheels is configured for facilitating a movement of the patient transfer system in a desired direction. The system also comprises one or more mechanical attachment devices. The mechanical attachment devices are configured for locking the patient transfer system to one or more firm/rigid surfaces to provide stability during patient transfer. The one or more firm/rigid surfaces comprise a floor, a wall and a ceiling. The system also comprises a column actuator attached/mounted on top of the main base. The column actuator is configured for moving vertically to adjust a height of the bed (system) to a level required for transferring a patient from one surface to another. The system further comprises a patient resting surface attached to or mounted on top of the column actuator. The patient resting surface comprises a bottom surface and a top surface. The bottom surface of the patient resting surface comprises a mattress and the top surface comprises a sheet mounted onto a frame. The sheet is configured for transforming into a hard surface by stretching the sheet in lengthwise to lift a weight of the patient during patient transfer. The frame is configured for moving in a horizontal and vertical direction to transfer the patient from one surface to another.

According to an embodiment herein, the sheet provided on the top surface of the patient transfer system is made up of a tensile resistant radiolucent material/fabric.

According to an embodiment herein, the mattress in the patient resting surface comprises four sections. The four sections comprise a head resting section, a back resting section, a leg resting section and a feet resting section.

According to an embodiment herein, the system is configured for transforming into a wheelchair by elevating the head resting section of the mattress by 90 degrees and lowering the leg and feet resting section by 90 degrees and subsequently elevating the feet resting section by 90 degrees.

According to an embodiment herein, the system further comprises one or more air-bags placed under the sheet. The one or more airbags in a blown up state are configured for enabling a side-wise movement of the patient resting on the sheet.

According to an embodiment herein, the one or more mechanical attachment devices further comprise a magnetic support attached at the base and a pedal/lever attached sideways. The magnetic support is configured for attaching to a magnetic frame mounted on the firm/rigid surface by pushing the lever in a particular direction. The magnetic support is configured for detaching from the firm/rigid surface by pushing the lever in an opposite direction.

According to an embodiment herein, the system further comprises one or more detachable L-shaped mechanical arm attached to the patient resting surface at one end and to a wall at the other end. The detachable L-shaped mechanical arms are configured for affixing the patient transfer system to a wall for providing stability during patient transfer.

According to an embodiment herein, the system further comprises a detachable vertical mechanical arm attached to the patient resting surface at one end and to a ceiling at the other end. The vertical mechanical arm is configured for affixing the patient transfer system to a ceiling for providing stability during patient transfer.

According to an embodiment herein, the system further comprises a retractable wheel support mechanism affixed to the main base. The retractable wheel support mechanism comprises one or more extendable rod/gear racks attached with wheels. The retractable wheel support mechanism is configured for extending the wheel base of the system to improve balance during patient transfer. The movable wheel support is operated using a motor.

According to an embodiment herein, the system further comprises a foldable pair of levers attached laterally to both ends of the patient resting surface. The foldable pair of levers are configured for attaching to another bed/stretcher by a screw in order to provide support and stability during patient transfer.

According to an embodiment herein, the system further comprises one or more actuators. The one or more actuators are configured for performing a plurality of tasks. The plurality of tasks comprise transforming the system to a wheelchair when needed, pulling the sheet on both sides for changing from a flexible state to hard surface and lowering/raising the sheet beneath the patient which in-turn lowers/raises the patient.

According to an embodiment herein, the system further comprises two engines coupled at two opposite ends of the patient resting surface. The two engines are configured for moving one or more rails coupled in the frame in either forward or backward direction. The movement of one or more rails in-turn moves the frame to transfer the patient from one surface to another.

According to an embodiment herein, the sheet further comprises a plurality of holes provided at two opposite ends of the patient resting surface. The plurality of holes are used for attaching the sheet to a plurality of pins present in one or more rails coupled with the frame of the patient resting surface.

According to an embodiment herein, a method of using the patient transfer system for transferring a patient form one surface to another is provided. The method comprises the steps of placing the patient transfer system carrying a patient near to another surface/bed on which the patient needs to be transferred and locking the patient transfer system to a firm surface using one or more mechanical attachment devices. The height of the patient transfer system is adjusted using a column actuator to match with a height of another surface. The sheet is stretched lengthwise using one or more actuators for transforming the sheet into a hard surface to lift a weight of the patient during transfer. A caretaker needs to insert the plurality of pins present in one or more rails of the patient resting surface into the plurality of holes in the sheet for attaching the sheet. The sheet and the patient are raised slightly above a mattress using one or more actuators and the sheet is moved over one or more rails for transferring the patient from the patient transfer system to another surface. The sheet carrying the patient is lowered into another surface using one or more actuators and the plurality of pins is detached from the plurality of sheet holes to complete the patient transfer process.

According to an embodiment herein, the method further comprises the step of moving one or more rails coupled in the frame in either forward or backward direction. The movement of one or more rails in-turn moves the frame to transfer the patient from one surface to another.

According to an embodiment herein, the method further comprises the step of moving the one or more rails back into place using one or more engines after a completion of patient transfer process.

According to an embodiment herein, the step of locking the patient transfer system further comprises attaching a magnetic support present in the mechanical attachment device to a magnetic frame mounted on a firm surface. The magnetic support is attached by pushing a lever provided in the mechanical attachment device in a particular direction. The magnetic support is detached from the firm surface by pushing the lever in an opposite direction on completion of a patient transfer process.

According to an embodiment herein, the step of locking the patient transfer system further comprises using a detachable L-shaped mechanical arm attached to the patient resting surface at one end and to a wall at the other end in case when the firm surface used for locking the system is a wall. A mechanical attachment device is provided at the wall end of the detachable L-shaped mechanical arm for locking purpose.

According to an embodiment herein, the step of locking the patient transfer system further comprises using a detachable vertical mechanical arm attached to the patient resting surface at one end and to a ceiling at the other end in case when the firm surface used for locking the system is a ceiling. A mechanical attachment device is provided at the ceiling end of the detachable vertical mechanical arm for locking purpose.

According to an embodiment herein, the method further comprises the step of transforming the patient transfer system into a wheelchair for easy maneuvering. The patient transfer system is transformed into wheelchair by elevating the head resting section of a mattress provided in the system by 90 degrees and lowering the leg and feet resting section by 90 degrees and subsequently elevating the feet resting section by 90 degrees.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the appended claims.

BRIEF DESCRIPTION OF THE DRAWINGS

The other objects, features and advantages will occur to those skilled in the art from the following description of the preferred embodiment and the accompanying drawings in which.

Figure 1:
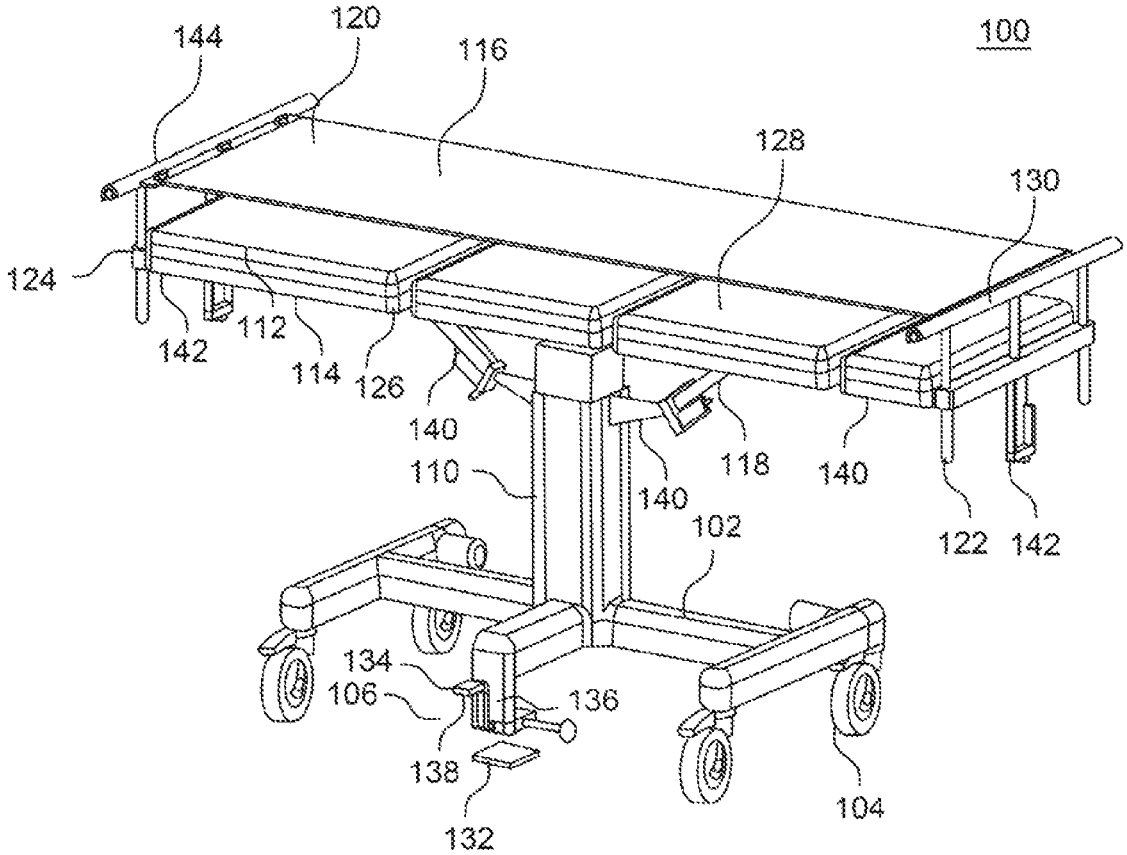
FIG. 1 illustrates a perspective view of a patient transfer system, according to an embodiment herein.

Although the specific features of the present invention are shown in some drawings and not in others. This is done for convenience only as each feature may be combined with any or all of the other features in accordance with the embodiments herein.

DETAILED DESCRIPTION OF THE EMBODIMENTS

In the following detailed description, a reference is made to the accompanying drawings that form a part hereof, and in which the specific embodiments that may be practiced is shown by way of illustration. These embodiments are described in sufficient detail to enable those skilled in the art to practice the embodiments and it is to be understood that the logical, mechanical and other changes may be made without departing from the scope of the embodiments. The following detailed description is therefore not to be taken in a limiting sense.

These and other aspects of the embodiments herein will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

The various embodiments herein provide a patient transfer system. The system comprises a bed, a frame, a main base comprising a plurality of caster wheels. The plurality of caster wheels is configured for facilitating a movement of the patient transfer system in a desired direction. The system also comprises one or more mechanical attachment devices. The mechanical attachment devices are configured for locking the patient transfer system to one or more firm/rigid surfaces to provide stability during patient transfer. The one or more firm/rigid surfaces comprise a floor, a wall and a ceiling. The system also comprises a column actuator attached/mounted on top of the main base. The column actuator is configured for moving vertically to adjust a height of the bed (system) to a level required for transferring a patient from one surface to another. The system further comprises a patient resting surface attached to or mounted on top of the column actuator. The patient resting surface comprises a bottom surface and a top surface. The bottom surface of the patient resting surface comprises a mattress and the top surface comprises a sheet mounted onto a frame. The sheet is configured for transforming into a hard surface by stretching the sheet in lengthwise to lift a weight of the patient during patient transfer. The frame is configured for moving in a horizontal and vertical direction to transfer the patient from one surface to another.

According to an embodiment herein, the sheet provided on the top surface of the patient transfer system is made up of a tensile resistant radiolucent material/fabric.

According to an embodiment herein, the mattress in the patient resting surface comprises four sections. The four sections comprise a head resting section, a back resting section, a leg resting section and a feet resting section.

According to an embodiment herein, the system is configured for transforming into a wheelchair by elevating the head resting section of the mattress by 90 degrees and lowering the leg and feet resting section by 90 degrees and subsequently elevating the feet resting section by 90 degrees.

According to an embodiment herein, the system further comprises one or more air-bags placed under the sheet. The one or more airbags in a blown up state are configured for enabling a side-wise movement of the patient resting on the sheet.

According to an embodiment herein, the one or more mechanical attachment devices further comprise a magnetic support attached at the base and a pedal/lever attached sideways. The magnetic support is configured for attaching to a magnetic frame mounted on the firm/rigid surface by pushing the lever in a particular direction. The magnetic support is configured for detaching from the firm/rigid surface by pushing the lever in an opposite direction.

According to an embodiment herein, the system further comprises one or more detachable L-shaped mechanical arm attached to the patient resting surface at one end and to a wall at the other end. The detachable L-shaped mechanical arms are configured for affixing the patient transfer system to a wall for providing stability during patient transfer.

According to an embodiment herein, the system further comprises a detachable vertical mechanical arm attached to the patient resting surface at one end and to a ceiling at the other end. The vertical mechanical arm is configured for affixing the patient transfer system to a ceiling for providing stability during patient transfer.

According to an embodiment herein, the system further comprises a retractable wheel support mechanism affixed to the main base. The retractable wheel support mechanism comprises one or more extendable rod/gear racks attached with wheels. The retractable wheel support mechanism is configured for extending the wheel base of the system to improve balance during patient transfer. The movable wheel support is operated using a motor.

According to an embodiment herein, the system further comprises a foldable pair of levers attached laterally to both ends of the patient resting surface. The foldable pair of levers are configured for attaching to another bed/stretcher by a screw in order to provide support and stability during patient transfer.

According to an embodiment herein, the system further comprises one or more actuators. The one or more actuators are configured for performing a plurality of tasks. The plurality of tasks comprise transforming the system to a wheelchair when needed, pulling the sheet on both sides for changing from a flexible state to hard surface and lowering/raising the sheet beneath the patient which in-turn lowers/raises the patient.

According to an embodiment herein, the system further comprises two engines coupled at two opposite ends of the patient resting surface. The two engines are configured for moving one or more rails coupled in the frame in either forward or backward direction. The movement of one or more rails in-turn moves the frame to transfer the patient from one surface to another.

According to an embodiment herein, the sheet further comprises a plurality of holes provided at two opposite ends of the patient resting surface. The plurality of holes are used for attaching the sheet to a plurality of pins present in one or more rails coupled with the frame of the patient resting surface.

According to an embodiment herein, a method of using the patient transfer system for transferring a patient form one surface to another is provided. The method comprises the steps of placing the patient transfer system carrying a patient near to another surface/bed on which the patient needs to be transferred and locking the patient transfer system to a firm surface using one or more mechanical attachment devices. The height of the patient transfer system is adjusted using a column actuator to match with a height of another surface. The sheet is stretched lengthwise using one or more actuators for transforming the sheet into a hard surface to lift a weight of the patient during transfer. A caretaker needs to insert the plurality of pins present in one or more rails of the patient resting surface into the plurality of holes in the sheet for attaching the sheet. The sheet and the patient are raised slightly above a mattress using one or more actuators and the sheet is moved over one or more rails for transferring the patient from the patient transfer system to another surface. The sheet carrying the patient is lowered into another surface using one or more actuators and the plurality of pins is detached from the plurality of sheet holes to complete the patient transfer process.

According to an embodiment herein, the method further comprises the step of moving one or more rails coupled in the frame in either forward or backward direction. The movement of one or more rails in-turn moves the frame to transfer the patient from one surface to another.

According to an embodiment herein, the method further comprises the step of moving the one or more rails back into place using one or more engines after a completion of patient transfer process.

According to an embodiment herein, the step of locking the patient transfer system further comprises attaching a magnetic support present in the mechanical attachment device to a magnetic frame mounted on a firm surface. The magnetic support is attached by pushing a lever provided in the mechanical attachment device in a particular direction. The magnetic support is detached from the firm surface by pushing the lever in an opposite direction on completion of a patient transfer process.

According to an embodiment herein, the step of locking the patient transfer system further comprises using a detachable L-shaped mechanical arm attached to the patient resting surface at one end and to a wall at the other end in case when the firm surface used for locking the system is a wall. A mechanical attachment device is provided at the wall end of the detachable L-shaped mechanical arm for locking purpose.

According to an embodiment herein, the step of locking the patient transfer system further comprises using a detachable vertical mechanical arm attached to the patient resting surface at one end and to a ceiling at the other end in case when the firm surface used for locking the system is a ceiling. A mechanical attachment device is provided at the ceiling end of the detachable vertical mechanical arm for locking purpose.

According to an embodiment herein, the method further comprises the step of transforming the patient transfer system into a wheelchair for easy maneuvering. The patient transfer system is transformed into wheelchair by elevating the head resting section of a mattress provided in the system by 90 degrees and lowering the leg and feet resting section by 90 degrees and subsequently elevating the feet resting section by 90 degrees.

FIG. 1 illustrates a perspective view of a patient transfer system, according to an embodiment herein. With respect to FIG. 1, the system comprises a main base 102 comprising of one or more wheels 104. The one or more wheels 104 are configured for providing required motion to the patient transfer system when needed. The system also comprises one or more mechanical attachment devices 106. The mechanical attachment devices 106 are configured for locking the patient transfer system to one or more firm surfaces 108 for providing stability during patient transfer. The one or more firm surfaces comprise a floor, a wall, a ceiling and the like. A column actuator 110 is attached on top of the main base 102. The column actuator 110 is configured for moving vertically in order to adjust height required for transferring a patient from one surface to another. The system further comprises a rectangular patient resting surface 112 attached on top of the column actuator 110. The patient resting surface 112 comprises a bottom surface 114 and a top surface 116. The bottom surface 114 of the patient resting surface comprises a mattress 118 and the top surface 116 comprises a sheet 120 mounted onto a frame 122. The sheet 120 is configured for transforming into a hard surface upon stretching lengthwise to lift the weight of the patient during patient transfer. The sheet 120 is made up of a tensile resistant radiolucent material/fabric and hence stays unaffected due to radiation encountered in X-ray, CT-scan, MRI machines etc. The frame 122 is configured for moving in a horizontal and vertical direction to transfer the patient from one surface to another.

According to an embodiment herein, the mattress 118 in the patient resting surface comprises four sections. The four sections comprise a head resting section 124, a back resting section 126, a leg resting section 128 and a feet resting section 130. The system is configured for transforming into a wheelchair by elevating the head resting section 124 of the mattress by 90 degrees and lowering the leg and feet resting section 128 and 130 by 90 degrees and subsequently elevating the feet resting section 130 by 90 degrees.

According to an embodiment herein, the system further comprises one or more air-bags (not shown) placed under the sheet. The one or more airbags in a blown up state are configured for enabling side-wise movement of the patient resting on the sheet 120.

According to an embodiment herein, the one or more mechanical attachment devices 106 further comprise a magnetic support 132 attached at the base and a pedal/lever 134/136 attached sideways. The magnetic support 132 is configured for attaching to a magnetic frame 138 mounted on the firm surface 108 by pushing the lever in a particular direction. The magnetic support 132 is configured for detaching from the firm surface 108 by pushing the lever in an opposite direction.

According to an embodiment herein, the system further comprises one or more actuators 140. The one or more actuators are configured for performing a plurality of tasks. The plurality of tasks comprise transforming the system to a wheelchair when needed, pulling the sheet on both sides for changing from a flexible state to hard surface and lowering/raising the sheet beneath the patient which in-turn lowers/raises the patient.

According to an embodiment herein, the system further comprises two engines 142 coupled at two opposite ends of the patient resting surface. The two engines 142 are configured for moving one or more rails 144 coupled in the frame 122 in either forward or backward direction. The movement of one or more rails 144 in-turn moves the frame 122 to transfer the patient from one surface to another.

Figure 2:
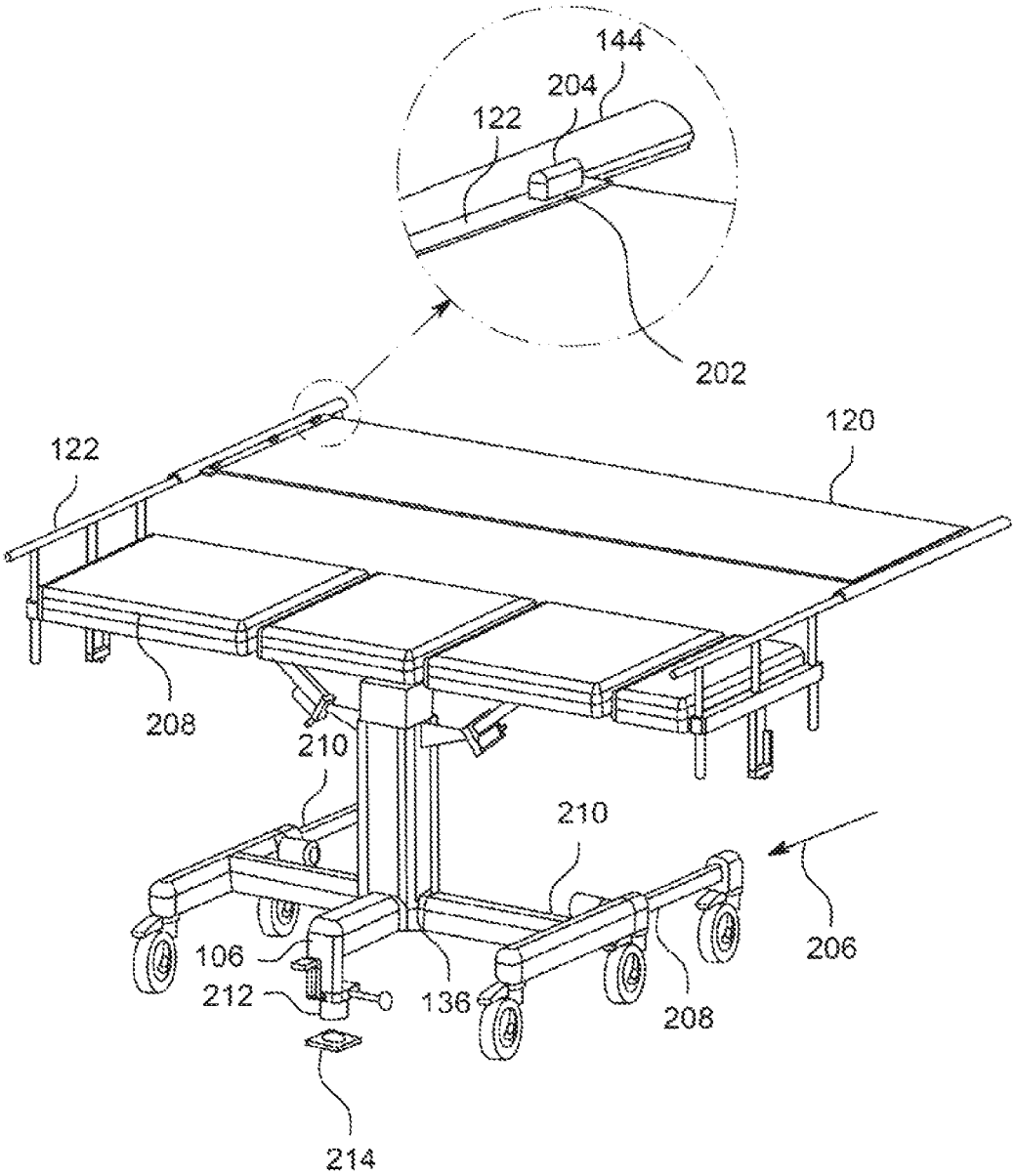
FIG. 2 illustrates a perspective view of a patient transfer system with sheet in a stretched condition in the patient transfer system, according to an embodiment herein.

FIG. 2 illustrates a perspective view of a patient transfer system with sheet in a stretched condition in the patient transfer system, according to an embodiment herein. With respect to FIG. 2, the sheet 120 further comprises a plurality of holes 202 at two opposite ends of the patient resting surface 112. The plurality of holes 202 are used for attaching the sheet 120 to the a plurality of pins 204 present in one or more rails 144 coupled with the frame 122 of the patient resting surface 112. The system further comprises a retractable wheel support mechanism 206 affixed to the main base 102. The retractable wheel support mechanism 206 comprises one or more extendable rod/gear racks 208 attached with wheels. The retractable wheel support mechanism 206 is configured for extending the wheel base of the system to improve balance during patient transfer. The movable wheel support is operated using a motor 210.

According to one embodiment herein, the stability of the system is achieved using a floor mechanical attachment device 106 which comprises a pin 212 that enters into a hole 214 and is locked by the lever 136 inside the hole 214.

Figure 3:
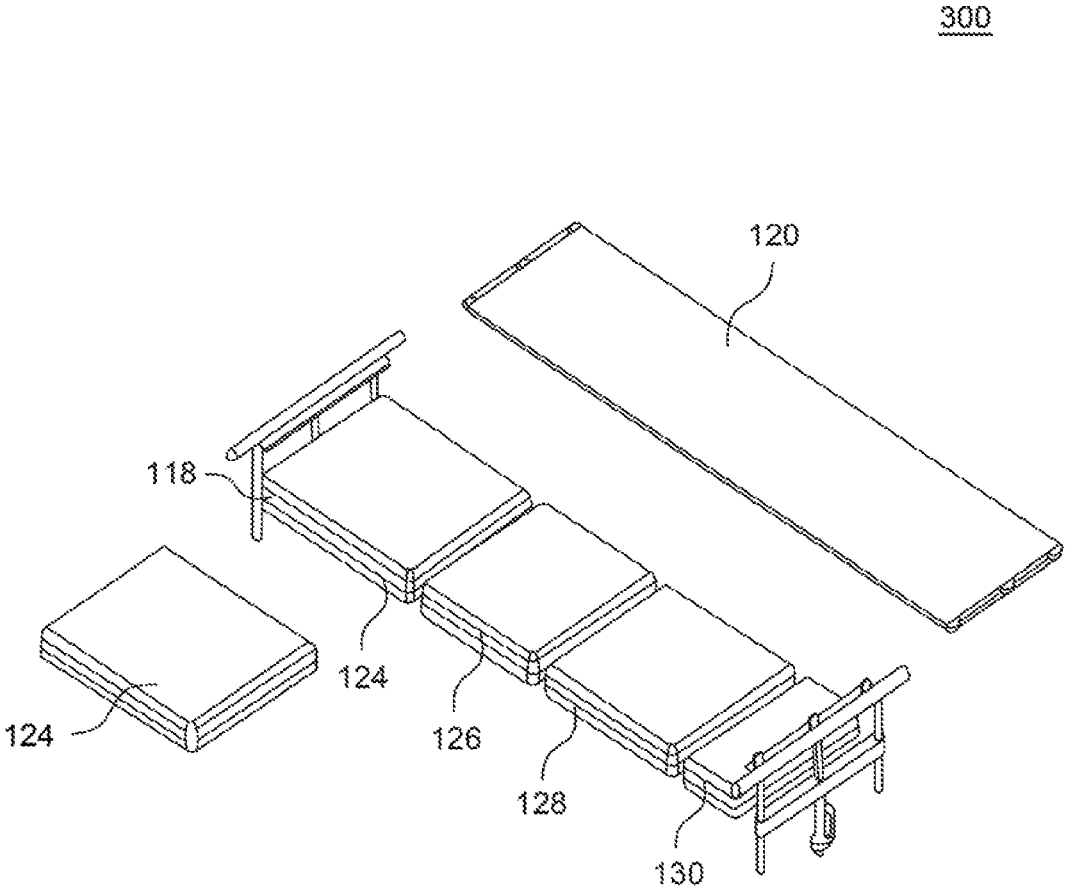
FIG. 3 illustrates an exploded assembly view of the patient transfer system indicating the sheet and mattress that are separated apart, according to an embodiment herein.

FIG. 3 illustrates an exploded assembly view of the patient transfer system indicating the sheet and mattress that are separated apart, according to an embodiment herein. With respect to FIG. 3, the mattress 118 and the sheet 120 are shown. The four sections of the mattress 118 that are the head resting section 124, the back resting section 126, the leg resting section 128 and the feet resting section 130 are also shown.

Figure 4:
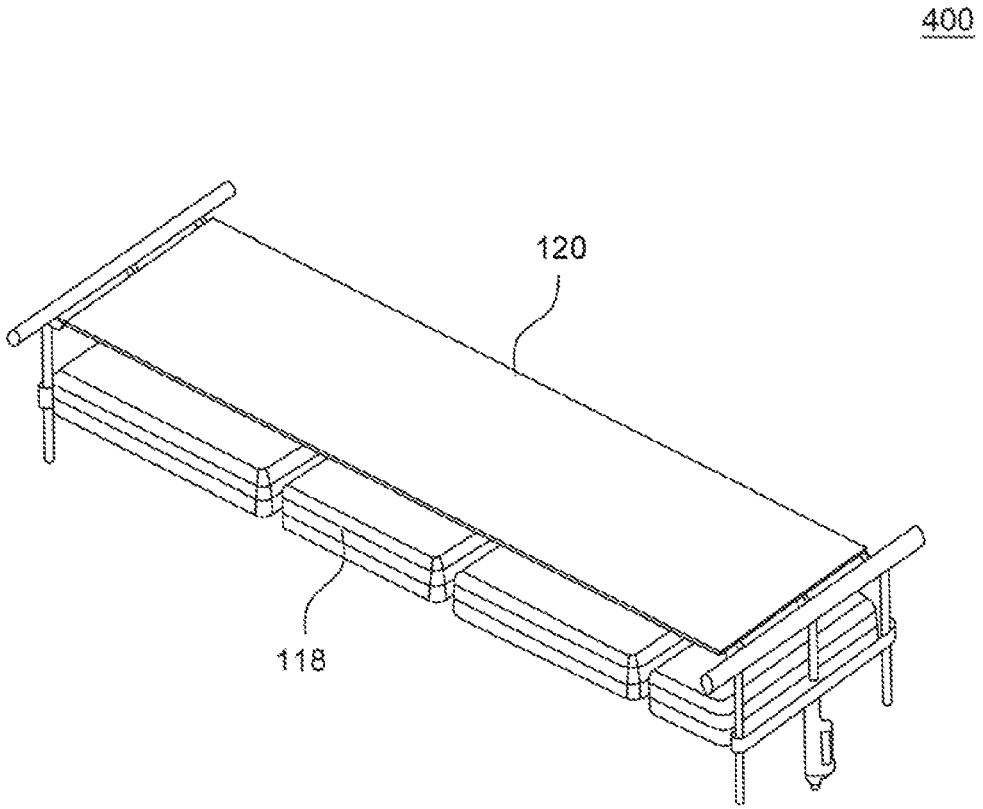
FIG. 4 illustrates a perspective view of the patient transfer system indicating a horizontal movement of sheet over the mattress, according to an embodiment herein.

FIG. 4 illustrates a perspective view of the patient transfer system indicating a horizontal movement of sheet over the mattress, according to an embodiment herein. With respect to FIG. 4, the sheet 120 is moved horizontally with respect to the mattress 118 for transferring the patient to another surface.

Figure 5:
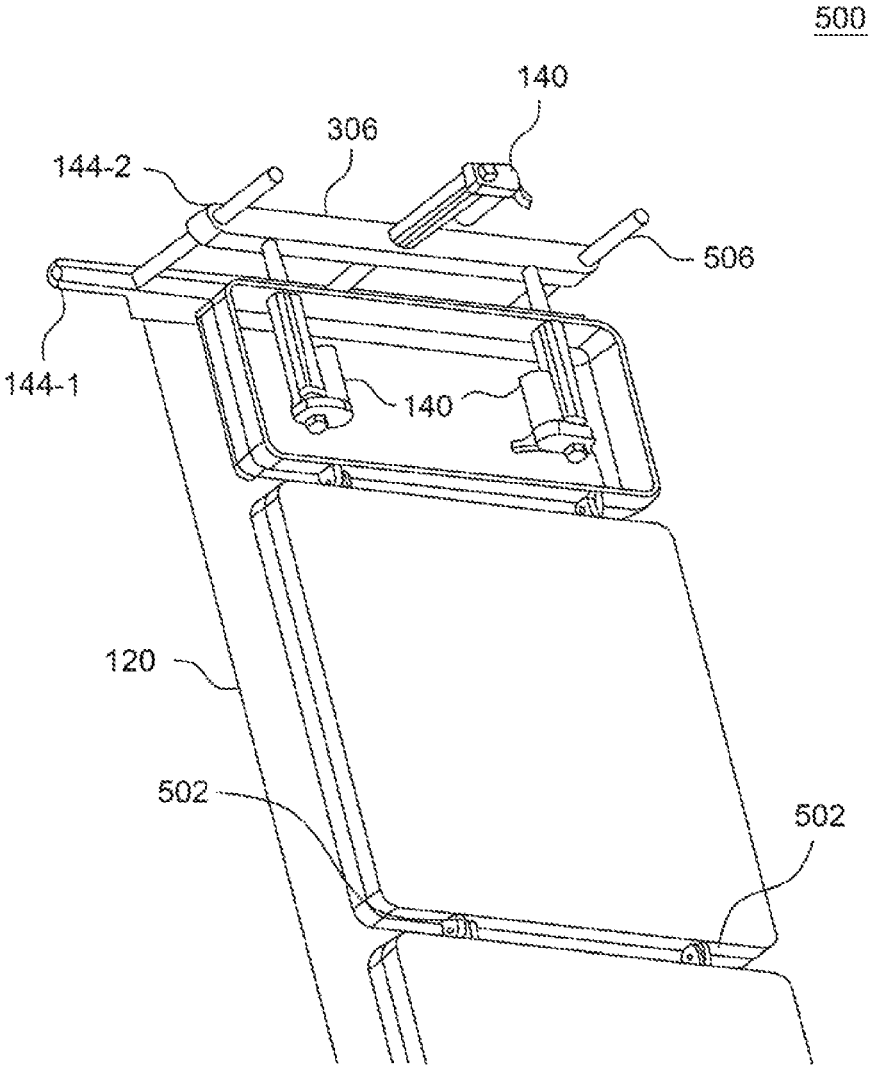
FIG. 5 illustrates a bottom view of the patient transfer system indicating the actuators, according to an embodiment herein.

FIG. 5 illustrates a bottom view of the patient transfer system indicating the actuators, according to an embodiment herein. With respect to FIG. 5, the one or more actuators 140 used in the patient transfer system are shown. Further the joints between different sections of the mattress 118 are also depicted using reference numeral 502. These joints allows folding and unfolding of the sections of mattress 118 to convert into a wheelchair. Further the one or more rails 144 used for horizontal (144-1) and vertical (144-2) movement of the frame 122 are also shown.

Figure 6:
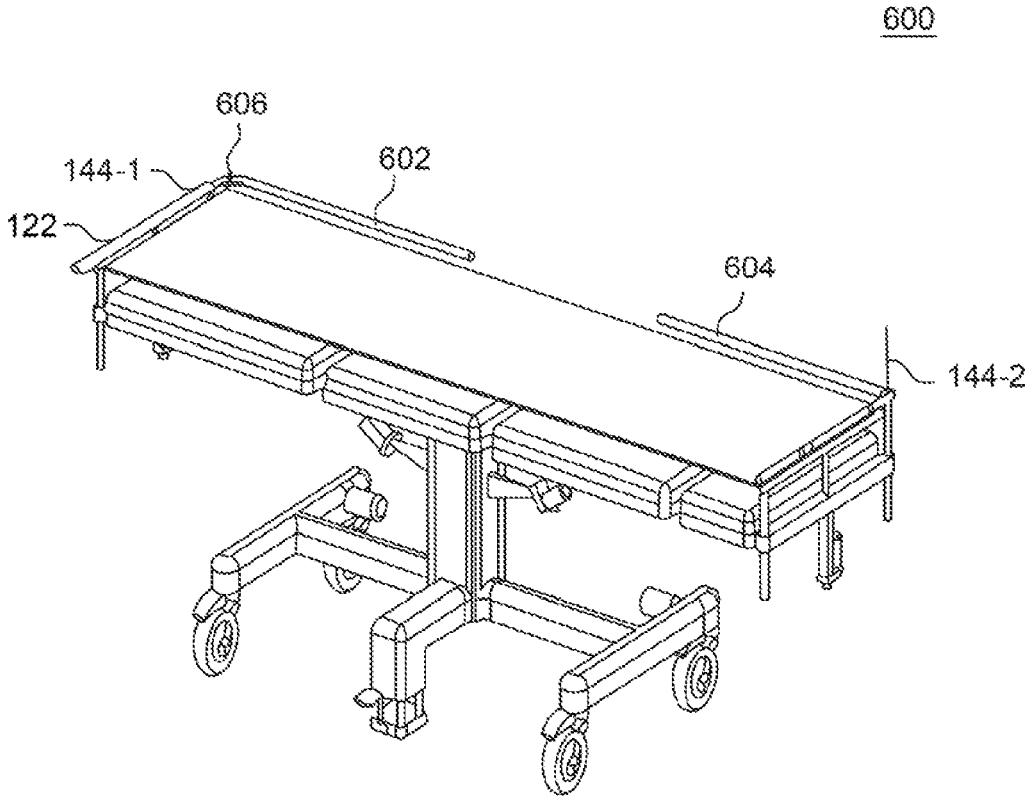
FIG. 6 illustrates a top side perspective view of the patient transfer system with a mechanical attachment device, according to an embodiment herein.

FIG. 6 illustrates a top side perspective view of the patient transfer system with a mechanical attachment device, according to an embodiment herein. With respect to FIG. 6, the horizontal (144-1) and vertical (144-2) movement of the one or more rails 144 present in the frame 122 is shown. The system further comprises a foldable pair of levers 602 and 604 attached laterally to both ends of the patient resting surface 112. The foldable pair of levers 602 and 604 are configured for attaching to another bed/stretcher by a screw 606 in order to provide support and stability during patient transfer.

Figure 7:
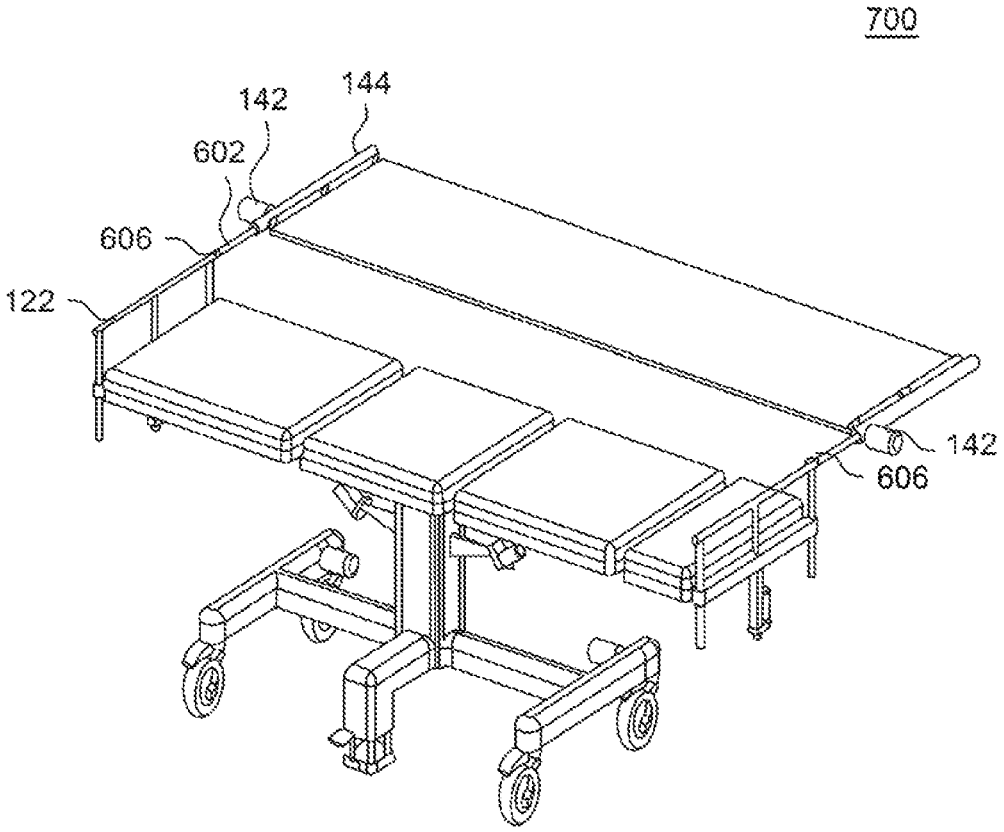
FIG. 7 illustrates a perspective view of the patient transfer system with the sheets in a horizontally moved condition, according to an embodiment herein.

FIG. 7 illustrates a perspective view of the patient transfer system with the sheets in a horizontally moved condition, according to an embodiment herein. With respect to FIG. 7, the use of two engines 142 for moving one or more rails 144 coupled in the frame 122 in either forward or backward direction is shown. The movement of one or more rails 144 in-turn moves the frame 122 to transfer the patient from one surface to another. The patient resting surface 112 is coupled with another surface using the pair of levers 602 and 604 and affixed with the help of screw 606. The frame 122 is then moved horizontally with the help of one or more rails 144.

Figure 8:
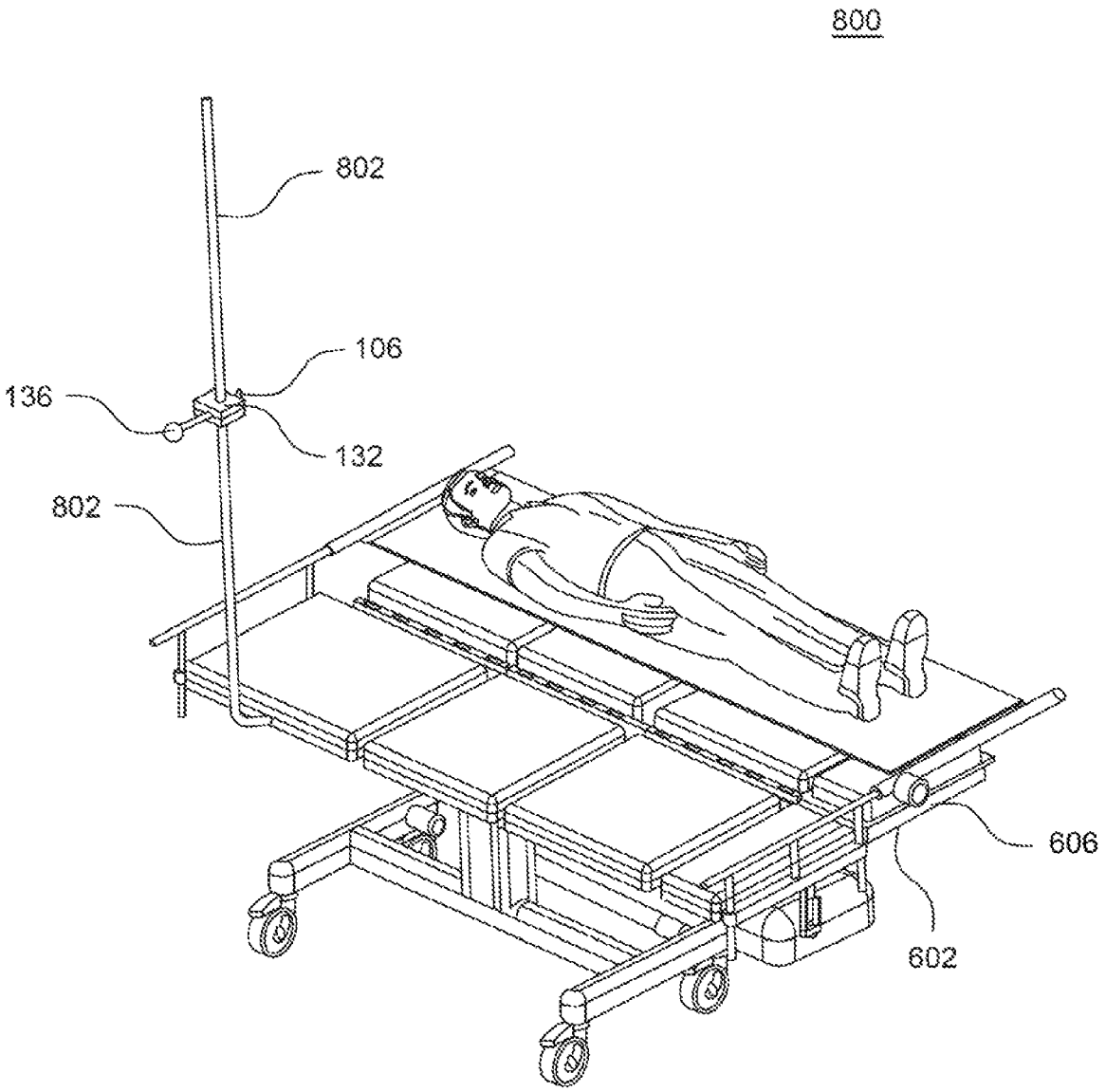
FIG. 8 illustrates a perspective view of the patient transfer system with a ceiling attachment mechanism, according to an embodiment herein.

FIG. 8 illustrates a perspective view of the patient transfer system with a ceiling attachment mechanism, according to an embodiment herein. With respect to FIG. 8, the system further comprises a detachable vertical mechanical arm 802 attached to the patient resting surface 112 at one end and to a ceiling 804 at the other end. The vertical mechanical arm 802 is configured for affixing the patient transfer system to the ceiling 804 for providing stability during patient transfer. As discussed earlier the mechanical attachment device 106 with the magnetic support 132 and the lever 136 is used in the vertical mechanical arm 802 for attachment purpose.

Figure 9:
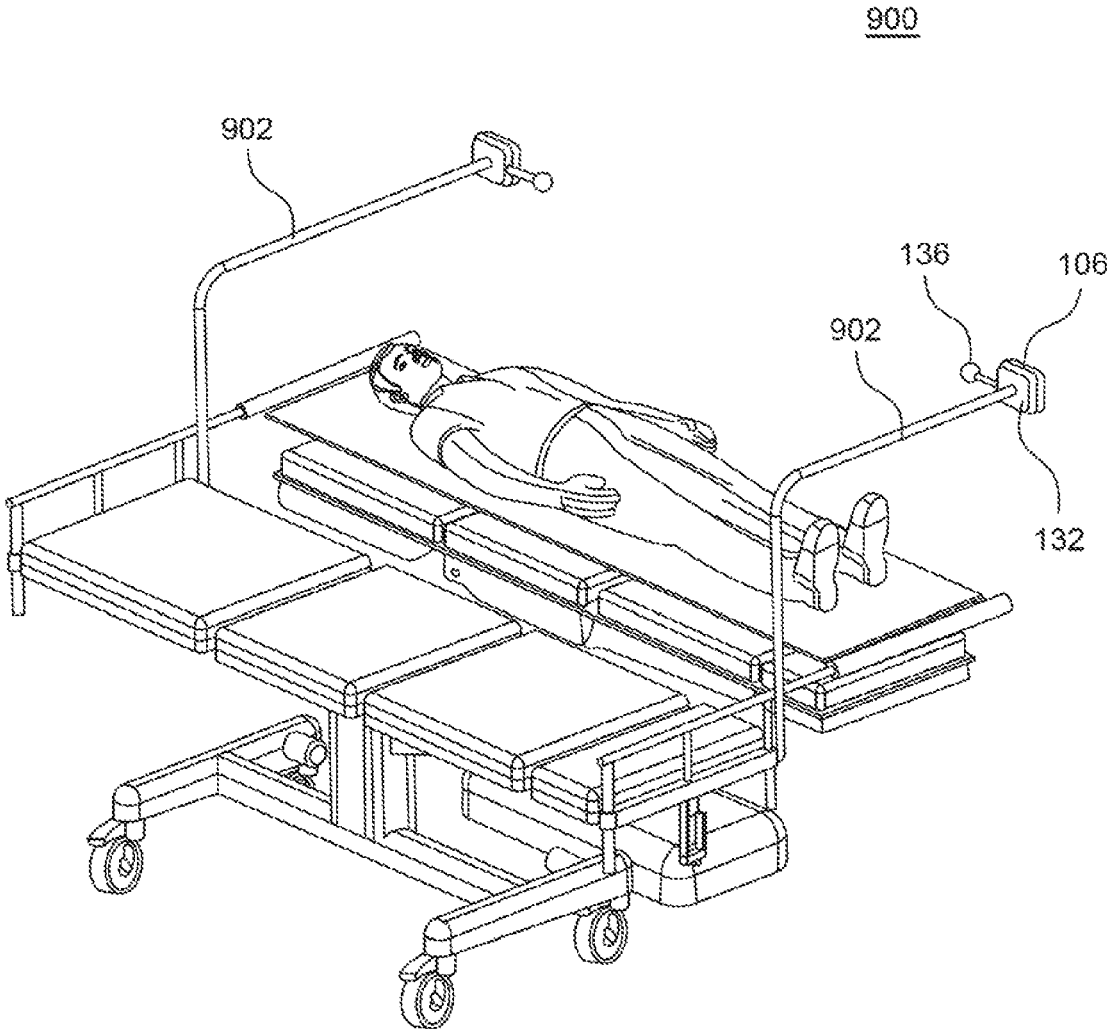
FIG. 9 illustrates a perspective view of the patient transfer system with a wall attachment mechanism, according to an embodiment herein.

FIG. 9 illustrates a perspective view of the patient transfer system with a wall attachment mechanism, according to an embodiment herein. With respect to FIG. 9, the system further comprises one or more detachable L-shaped mechanical arms 902 attached to the patient resting surface 112 at one end and to a wall at the other end. The detachable L-shaped mechanical arm is configured for affixing the patient transfer system to a wall for providing stability during patient transfer. In this case also, the mechanical attachment device 106 with the magnetic support 132 and the lever 136 is used in the L-shaped mechanical arms 902 for attachment purpose.

Figure 10:
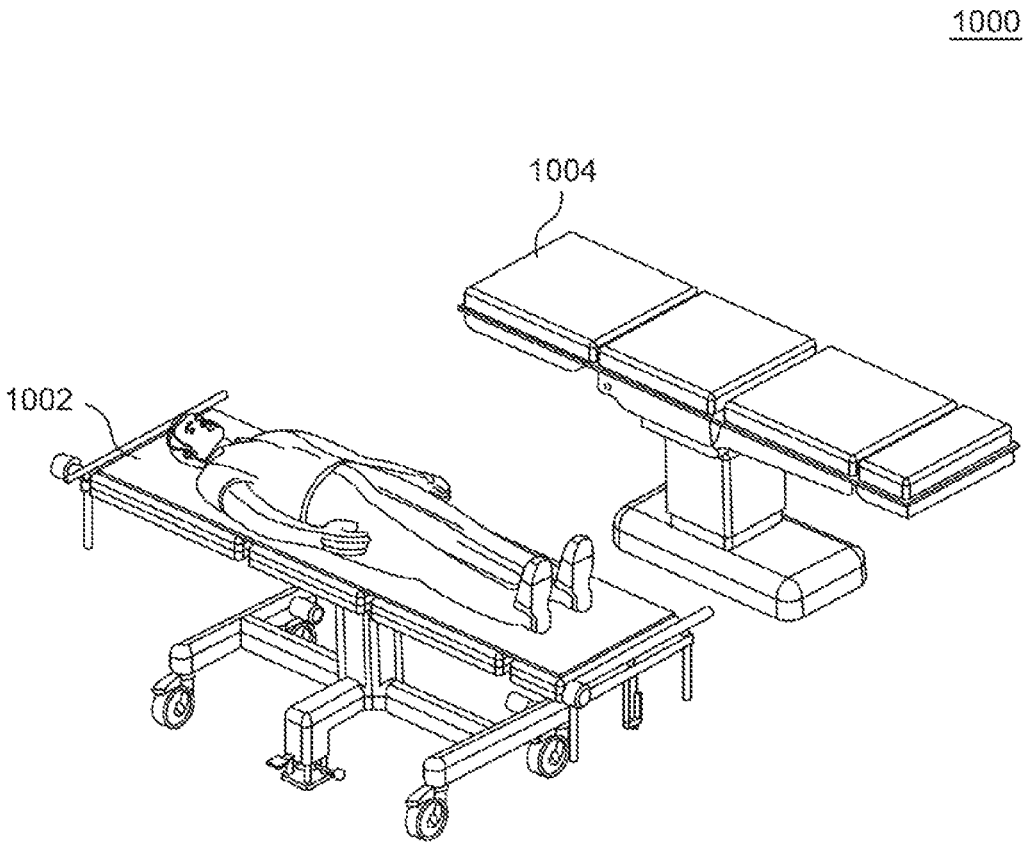
FIG. 10 illustrates a perspective view of the patient transfer system indicating a patient transfer process from one stretcher to another, according to an embodiment herein.

FIG. 10 illustrates a perspective view of the patient transfer system indicating a patient transfer process from one stretcher to another, according to an embodiment herein. With respect to FIG. 10, a patient transfer system 1002 carrying a patient to be transferred to another bed 1004 is shown. The patient transfer system 1002 is attached to the magnetic frame 138 present in the floor for affixing the system to provide stability during patient transfer.

Figure 11:
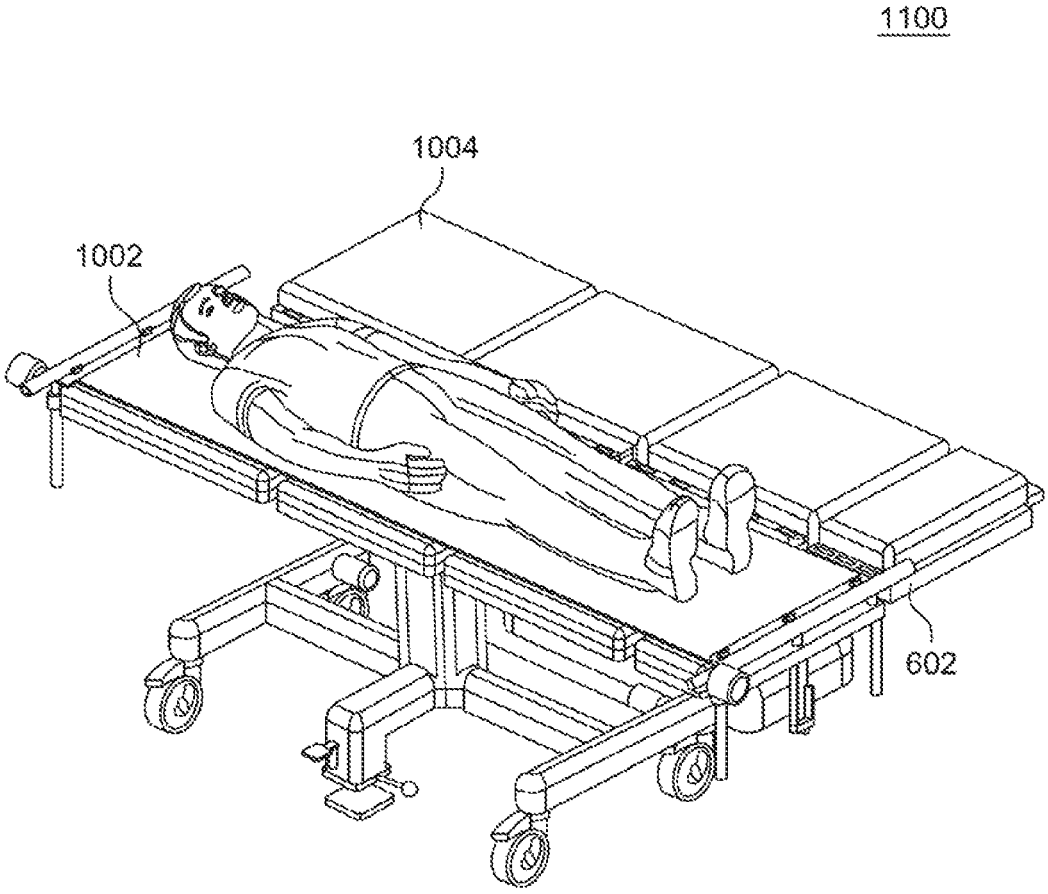
FIG. 11 illustrates a perspective view of the patient transfer system indicating an attachment of the patient transfer system with another surface for patient transfer, according to an embodiment herein.

FIG. 11 illustrates a perspective view of the patient transfer system indicating an attachment of the patient transfer system with another surface for patient transfer, according to an embodiment herein. With respect to FIG. 11, another bed 1004 is attached to the patient transfer system 1002 using foldable pair of levers 602 and 604.

Figure 12:
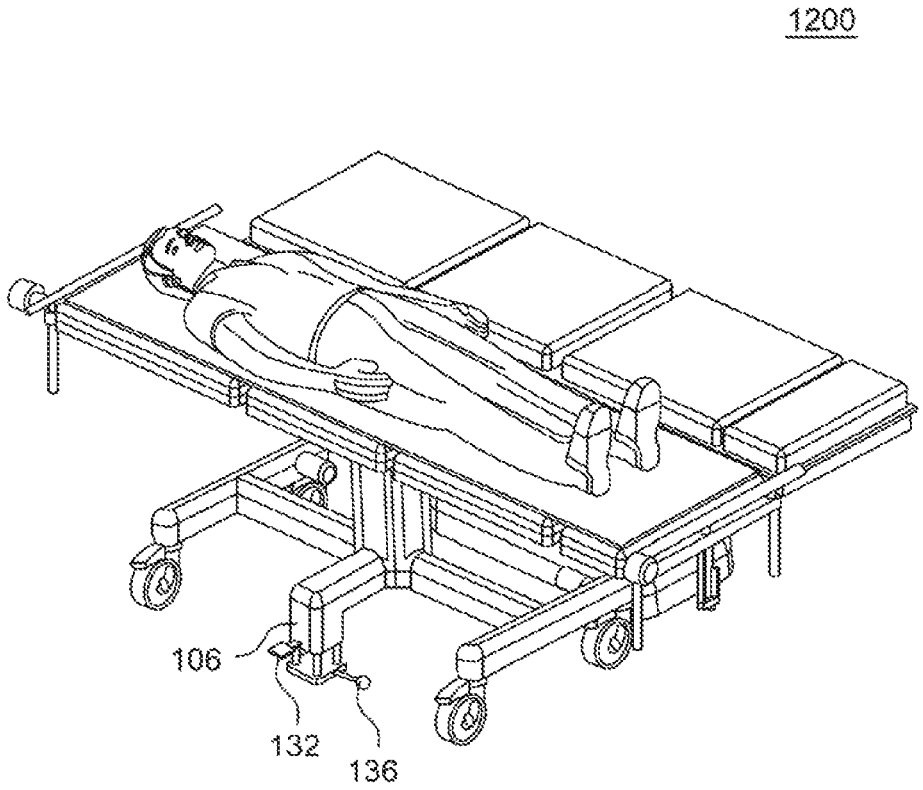
FIG. 12 illustrates a perspective view of the patient transfer system with the patient transfer system carrying the patient is attached to the ground, according to an embodiment herein.

FIG. 12 illustrates a perspective view of the patient transfer system with the patient transfer system carrying the patient is attached to the ground, according to an embodiment herein. With respect to FIG. 12, the patient transfer system 1002 is affixed to the floor using the mechanical attachment device 106. The lever 136 is pulled in a particular direction for attaching the magnetic support 132 with the magnetic frame 138 present in the floor.

Figure 13:
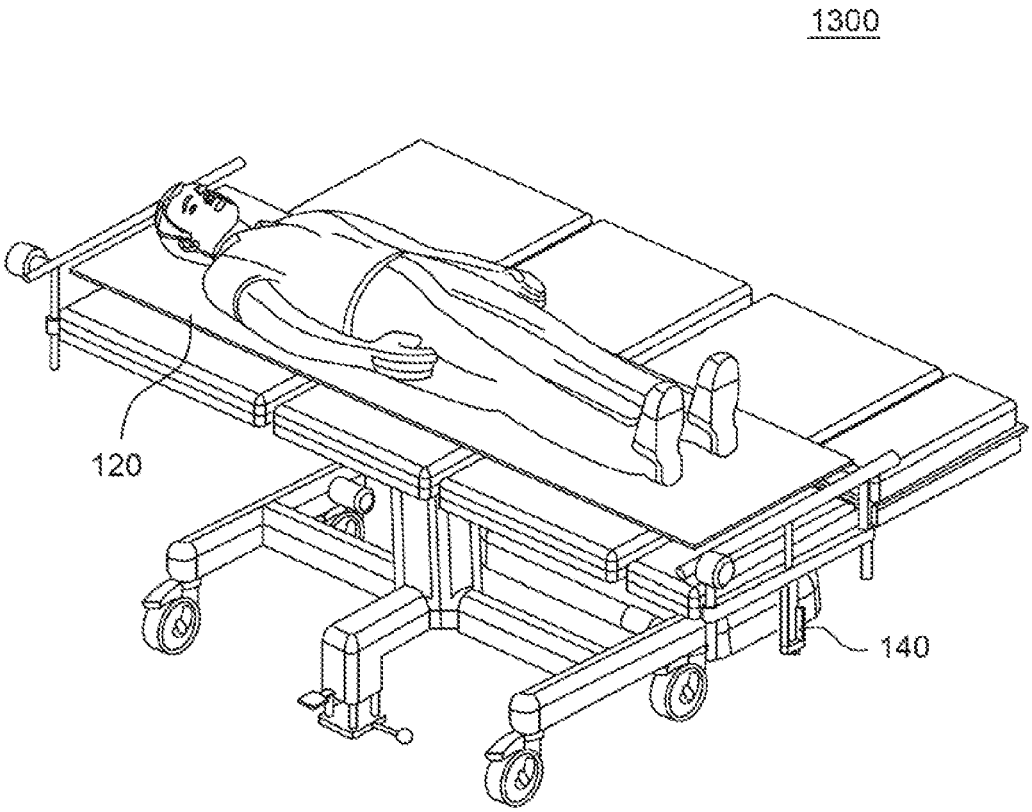
FIG. 13 illustrates a perspective view of the patient transfer system indicating the process of lifting the patient using a sheet from the system for transfer, according to an embodiment herein.

FIG. 13 illustrates a perspective view of the patient transfer system indicating the process of lifting the patient using a sheet from the system for transfer, according to an embodiment herein. With respect to FIG. 13, the sheet 120 carrying the patient is raised upwards using one or more actuators 140 for transferring to another surface.

Figure 14:
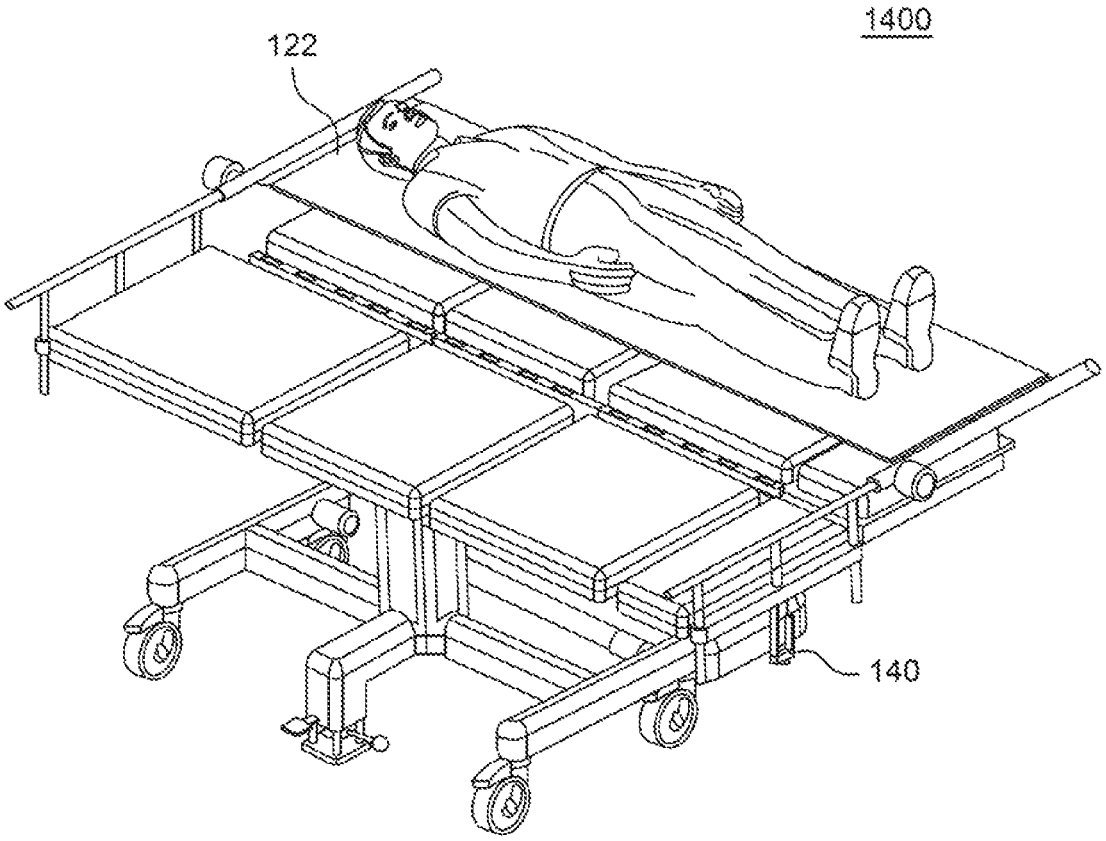
FIG. 14 illustrates a perspective view of the patient transfer system with the patient transferred to another surface through the actuators, according to an embodiment herein.

FIG. 14 illustrates a perspective view of the patient transfer system with the patient transferred to another surface through the actuators, according to an embodiment herein. With respect to FIG. 14, the frame 122 carrying the patient is moved horizontally using one or more actuators 140 to reach another surface.

Figure 15:
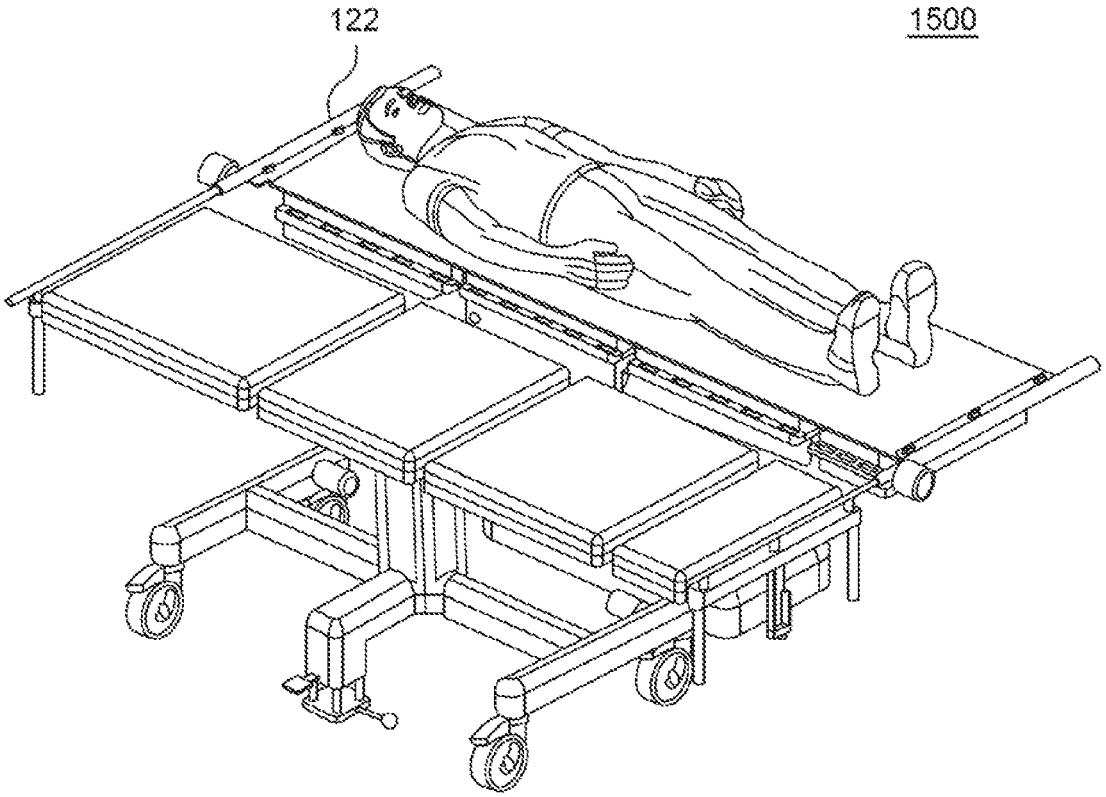
FIG. 15 illustrates a perspective view of the patient transfer system with the sheet carrying patient in lowered condition for transferring patient to another surface, according to an embodiment herein.

FIG. 15 illustrates a perspective view of the patient transfer system with the sheet carrying patient in lowered condition for transferring patient to another surface, according to an embodiment herein. With respect to FIG. 15, the frame 122 carrying the patient is lowered onto another surface for placing over it.

Figure 16:
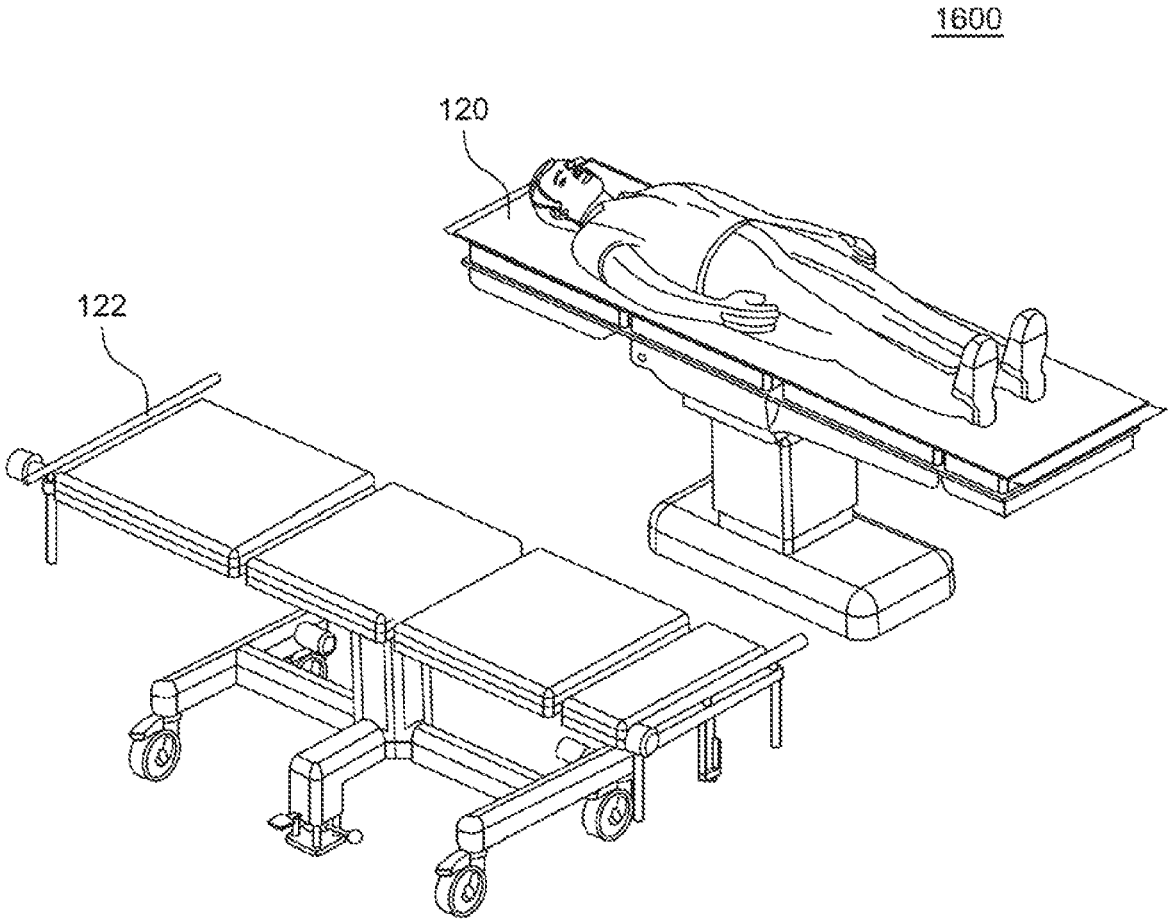
FIG. 16 illustrates a perspective view of the patient transfer system in a detached condition from another surface after completion of the patient transfer process, according to an embodiment herein.

FIG. 16 illustrates a perspective view of the patient transfer system in a detached condition from another surface after completion of the patient transfer process, according to an embodiment herein. With respect to FIG. 16, once the frame 122 is lowered onto another surface, the sheet 120 carrying the patient is detached from the system to complete the patient transfer process.

Figure 17:
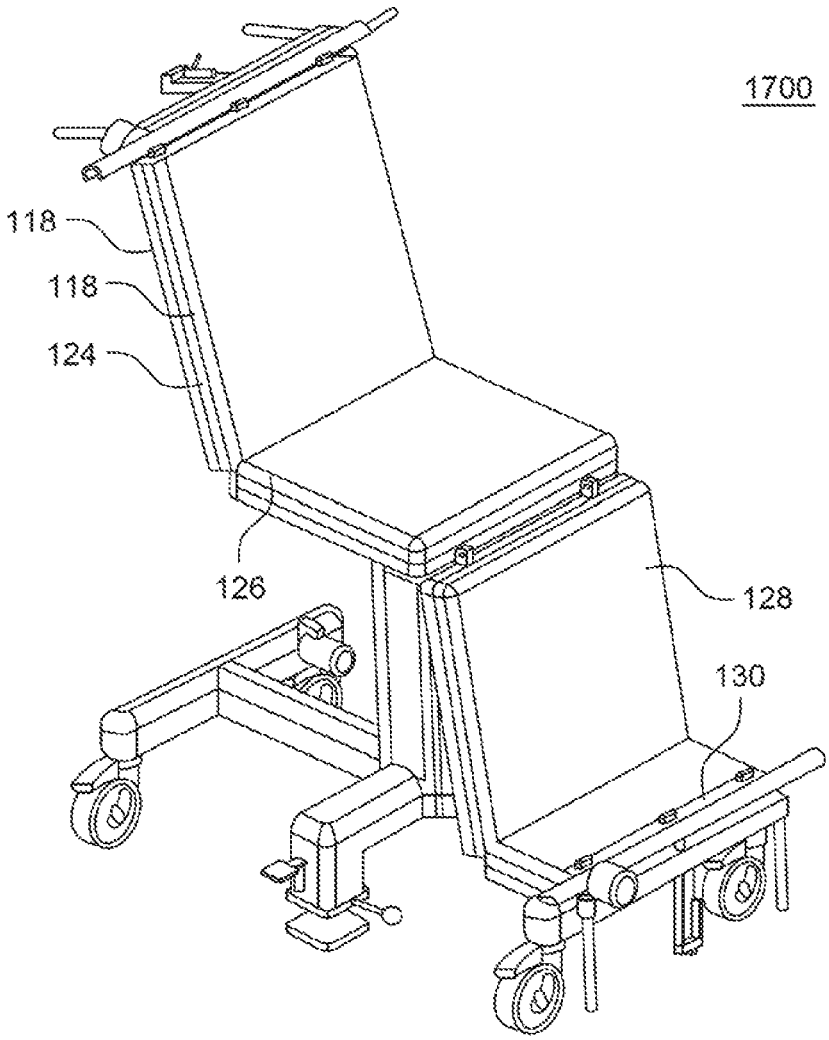
FIG. 17 illustrates a perspective view of the patient transfer system converted into a wheel chair after completion of patient transfer activity for easy maneuvering, according to an embodiment herein.

FIG. 17 illustrates a perspective view of the patient transfer system converted into a wheel chair after completion of patient transfer activity for easy maneuvering, according to an embodiment herein. With respect to FIG. 17, the patient transfer system is transformed into a wheelchair by elevating the head resting section 124 of the mattress 118 by 90 degrees and lowering the leg and feet resting section 128 and 130 by 90 degrees and subsequently elevating the feet resting section 130 by 90 degrees.

According to an embodiment herein, the magnets used in the mechanical attachment device 106 can handle about 1.5 tons of weight. Similarly, the frame is configured to carry a patient weighing about 800 Kilograms.

Figure 18:
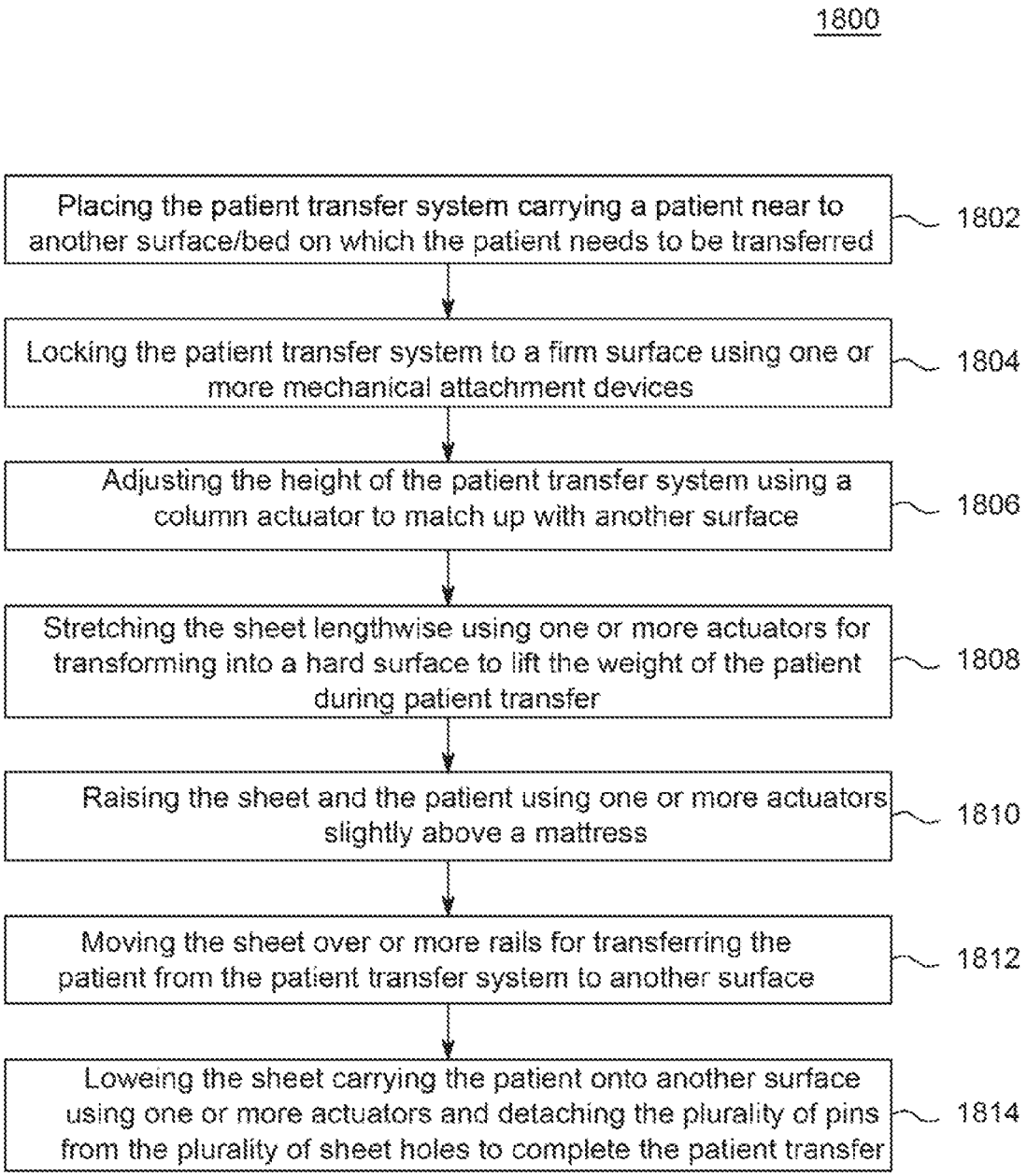
FIG. 18 illustrates a flowchart explaining a process transferring patient using the patient transfer system, according to an embodiment herein.

FIG. 18 illustrates a flowchart explaining a process transferring patient using the patient transfer system, according to an embodiment herein. With respect to FIG. 18, the method comprises the step of placing the patient transfer system carrying a patient near to another surface/bed on which the patient needs to be transferred (1802) and locking the patient transfer system to a firm surface using one or more mechanical attachment devices (1804). The method also comprises adjusting the height of the patient transfer system using a column actuator to match up with another surface (1806) and stretching the sheet lengthwise using one or more actuators for transforming into a hard surface to lift the weight of the patient during patient transfer (1808). The method further comprises raising the sheet and the patient using one or more actuators slightly above a mattress (1810) and moving the sheet over one or more rails for transferring the patient from the patient transfer system to another surface (1812). The method still further comprises lowering the sheet carrying the patient onto another surface using one or more actuators and detaching the plurality of pins form the plurality of sheet holes to complete the patient transfer (1814).

Therefore, the patient transfer system helps a caretaker/attendant in transferring a patient form one surface to another single handedly. The system uses a special sheet that stretches to form a hard surface for easy patient transfer. The sheet is made out of radiolucent material and hence stays unaffected due to different types of radiations encountered while using X-ray, CT scan, MRI machines and the like. The system facilitates horizontal as well as vertical movement of the patient for easy transfer.

Further, the patient transfer system is easily convertible into a wheelchair whenever needed. The system further comprises several mechanical attachment devices that gets attached/affixed and locked to any firm surface like floor, wall, ceiling etc. to aid patient transfer by providing mechanical stability. This mechanism of attachment to firm surfaces is also useful in industries that require lifting of heavy objects or parcels on shelves. The system also comprises airbags that are helpful in moving the patients sideways when inflated for preventing bedsores due to resting in same position for longer.

Figure 19:
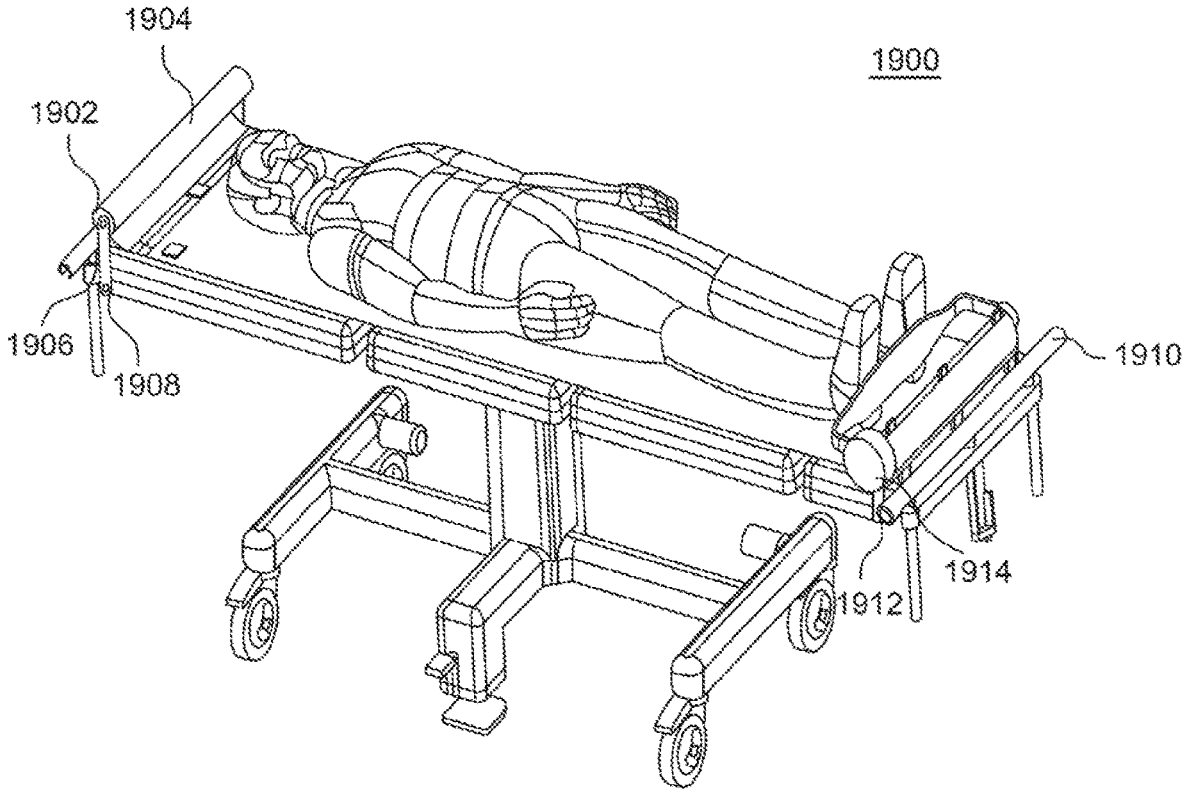
FIG. 19 illustrates a perspective view of a system with a roller for changing a dirty or old linen/sheet under a patient by a new sheet, according to an embodiment herein.

FIG. 19 illustrates a perspective view of a system for changing a dirty or old linen/sheet under a patient with a new sheet, according to an embodiment herein. The system comprises a first padding roller 1902 coupled to the patient transfer system at an end of a head rest section. A one or more sheets 1904 are wrapped up around the first padding roller. The first padding roller 1902 is configured for rolling around a first base 1906. The first base 1906 is connected to the patient transfer system using one or more pins 1908. The system also comprises a second padding roller 1910 coupled to the patient transfer system at a foot rest section end. The second padding roller 1910 is configured for rotating around a second base 1912. The second padding roller 1910 is configured for gathering the old/used sheet under the patient. The second padding roller 1910 is actuated using a motor 1914. The second padding roller 1910 upon activation by the motor 1914 is configured for rolling the old/dirty sheet under the patient over the second padding roller 1910 and pulling the new sheet from first padding roller 1902 under the patient.

Figure 20:
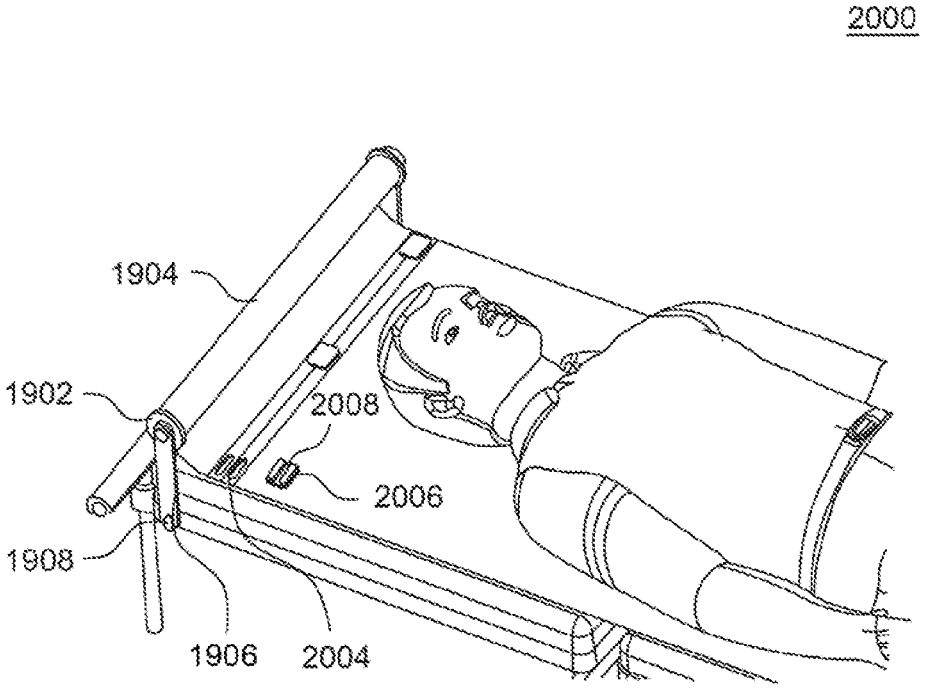
FIG. 20 illustrates a perspective view of the first roller with new sheets wrapped around in a system for changing a dirty or old linen/sheet under a patient by a new sheet,, according to an embodiment herein.

FIG. 20 illustrates a perspective view of the first roller with new sheets wrapped around, according to an embodiment herein. With respect to FIG. 20, the first padding roller 1902, the one or more sheets 1904, the base 1906, the pins 1908 are shown. Here, the sheet is attached to the first roller 1902 by pins 2002 inserting into holes 2004 on the sheet. The old sheet and the new ones are attached by part 2006 and pins 2008 as shown.

Figure 21:
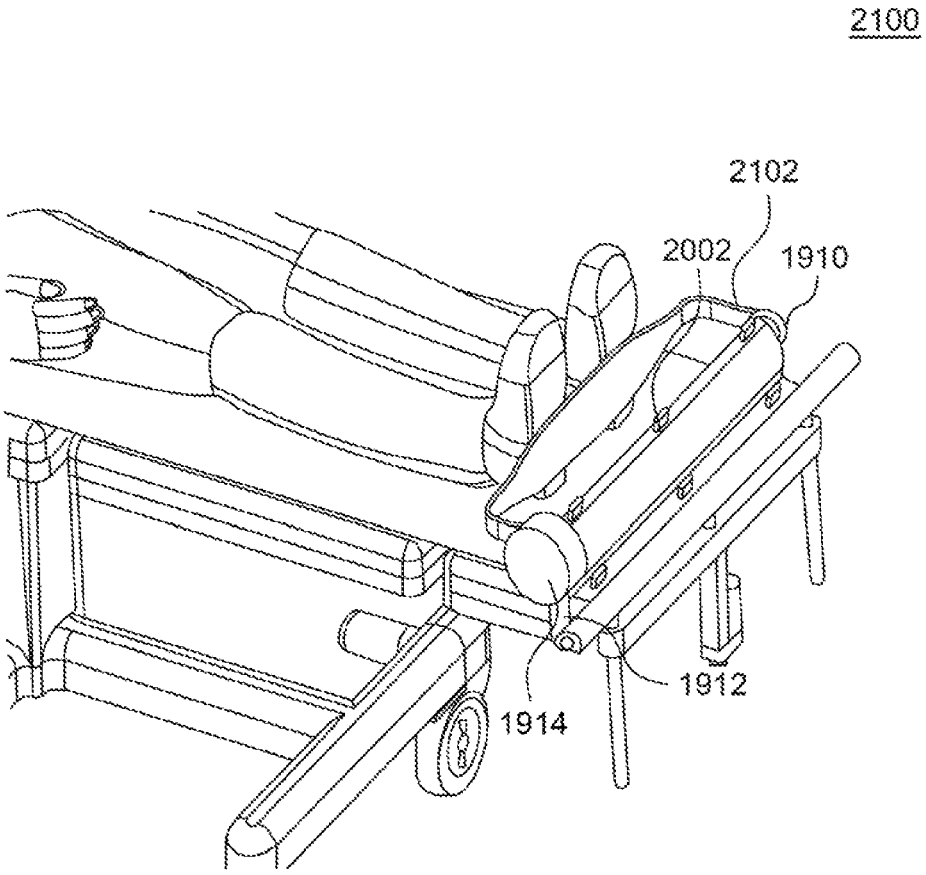
FIG. 21 illustrates a perspective view of the second roller configured for pulling old sheet under the patient in a system for changing a dirty or old linen/sheet under a patient by a new sheet according to an embodiment herein.

FIG. 21 illustrates a perspective view of the second roller configured for pulling old sheet under the patient, according to an embodiment herein. With respect to FIG. 21, the second roller 1910 and the pins 2002 are shown. Here, the sliding down of the patient from the patient resting surface while changing the sheet is prevented using a special part 2102 as shown.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the appended claims.

Although the embodiments herein are described with various specific embodiments, it will be obvious for a person skilled in the art to practice the invention with modifications. However, all such modifications are deemed to be within the scope of the claims.

It is also to be understood that the following claims are intended to cover all of the generic and specific features of the embodiments described herein and all the statements of the scope of the embodiments which as a matter of language might be the to fall there between.

What is claimed is:

1. A patient transfer system, the system comprising:

a main base comprising of a plurality of caster wheels, and wherein the plurality of caster wheels is configured to move the patient transfer system in a desired direction;

one or more mechanical attachment devices, and wherein the one or more mechanical attachment devices are configured for locking the patient transfer system to one or more firm surfaces to provide stability during patient transfer;

a column actuator attached on top of the main base, and wherein the column actuator is configured for moving vertically to adjust a height of the system to a level required for transferring a patient from one surface to another; and a patient resting surface attached on top of the column actuator, and wherein the patient resting surface comprises a bottom surface and a top surface, and wherein the bottom surface of the patient resting surface comprises a mattress and wherein the top surface comprises a sheet mounted onto a frame, and wherein the sheet is configured for transforming into a hard surface by stretching in lengthwise to lift a weight of the patient during patient transfer, and wherein the frame is configured for moving in a horizontal direction and in a vertical direction to transfer the patient from one surface to another;

wherein the one or more mechanical attachment device comprise a magnetic frame coupled to the firm surface and a magnetic support coupled to the main base, the magnetic support having a portion made of a magnetically attractable material and a lever operable to magnetically engage or disengage the portion to the magnetic frame.

2. The system according to claim 1, wherein the sheet used in the top surface of the patient transfer system is made up of a tensile resistant radiolucent material/fabric.

3. The system according to claim 1, wherein the mattress in the patient resting surface comprises four sections, and wherein the four sections comprise a head resting section, a back resting section, a leg resting section and a feet resting section.

4. The system according to claim 1, wherein the system is configured for transforming into a wheelchair by elevating the head resting section of the mattress by 90 degrees and lowering the leg and feet resting section by 90 degrees and subsequently elevating the feet resting section by 90 degrees.

5. The system according to claim 1 further comprises one or more air-bags placed under the sheet, and wherein the one or more airbags in a blown up state are configured for enabling side-wise movement of the patient resting on the sheet.

6. The system according to claim 1 further comprises one or more detachable L-shaped mechanical arms attached to the patient resting surface at one end and to a wall at the other end, and wherein the one or more detachable L-shaped mechanical arms are configured for affixing the patient transfer system to a wall for providing stability during patient transfer.

7. The system according to claim 1 further comprises a detachable vertical mechanical arm attached to the patient resting surface at one end and to a ceiling at the other end, and wherein the vertical mechanical arm is configured for affixing the patient transfer system to a ceiling for providing stability during patient transfer.

8. The system according to claim 1 further comprises a retractable wheel support mechanism affixed to the main base, and wherein the retractable wheel support mechanism comprises one or more extendable rod/gear racks attached with wheels, and wherein the retractable wheel support mechanism is configured for extending the wheel base of the system to improve balance during patient transfer, and wherein the movable wheel support is operated using a motor.

9. The system according to claim 1 further comprises one or more actuators, and wherein the one or more actuators are configured for performing a plurality of tasks, and wherein the plurality of tasks comprise transforming the system to a wheelchair when needed, pulling the sheet on both sides for changing from a flexible state to hard surface and lowering/raising the sheet beneath the patient which in-turn lowers/raises the patient.

10. The system according to claim 1 further comprises two engines coupled at two opposite ends of the patient resting surface, and wherein the two engines are configured for moving one or more rails coupled in the frame in either forward or backward direction, and wherein the movement of one or more rails in-turn moves the frame to transfer the patient from one surface to another.

11. The system according to claim 1, wherein the sheet further comprises a plurality of holes provided at two opposite ends of the patient resting surface, and wherein the plurality of holes are provided for attaching the sheet to the a plurality of pins present in one or more rails coupled with the frame of the patient resting surface.

12. A method of using a patient transfer system for transferring a patient form one surface to another, the patient transfer system comprising:

a main base comprising of a plurality of caster wheels, and wherein the plurality of caster wheels is configured to move the patient transfer system in a desired direction;

one or more mechanical attachment devices, and wherein the one or more mechanical attachment devices are configured for locking the patient transfer system to one or more firm surfaces to provide stability during patient transfer;

a column actuator attached on top of the main base, and wherein the column actuator is configured for moving vertically to adjust a height of the system to a level required for transferring a patient from one surface to another; and a patient resting surface attached on top of the column actuator, and wherein the patient resting surface comprises a bottom surface and a top surface, and wherein the bottom surface of the patient resting surface comprises a mattress and wherein the top surface comprises a sheet mounted onto a frame, and wherein the sheet is configured for transforming into a hard surface by stretching in lengthwise to lift a weight of the patient during patient transfer, and wherein the frame is configured for moving in a horizontal direction and in a vertical direction to transfer the patient from one surface to another;

wherein the one or more mechanical attachment device comprise a magnetic frame coupled to the firm surface and a magnetic support coupled to the main base, the magnetic support having a portion made of a magnetically attractable material and a lever operable to magnetically engage or disengage the portion to the magnetic frame, and wherein the method comprises the steps of:

placing the patient transfer system carrying the patient near to another surface/bed on which the patient needs to be transferred;

locking the patient transfer system to the firm surface using the one or more mechanical attachment devices;

adjusting a height of the patient transfer system using the column actuator to match up with the another surface;

stretching the sheet in lengthwise with the one or more actuators for transforming the sheet into a hard surface to lift the weight of the patient during patient transfer, and wherein a caretaker needs to insert the plurality of pins present in one or more rails of the patient resting surface into the plurality of holes in the sheet for attaching the sheet;

raising the sheet and the patient using the one or more actuators slightly above a mattress;

moving the sheet over one or more rails for transferring the patient from the patient transfer system to the another surface; and lowering the sheet carrying the patient onto the another surface using the one or more actuators and detaching the plurality of pins form the plurality of sheet holes to complete the patient transfer.

13. The method according to claim 12 further comprises moving one or more rails coupled in the frame in either forward or backward direction, and wherein the movement of one or more rails in-turn moves the frame to transfer the patient from one surface to another.

14. The method according to claim 13 further comprises the step of moving the one or more rails back into place using one or more engines after completion of patient transfer.

15. The method according to claim 12, wherein the step of locking the patient transfer system further comprises using a detachable L-shaped mechanical arm attached to the patient resting surface at one end and to a wall at the other end in case when the firm surface used for locking the system is a wall, and wherein a mechanical attachment device is provided at the wall end of the detachable L-shaped mechanical arm for locking purpose.

16. The method according to claim 12, wherein the step of locking the patient transfer system further comprises using a detachable vertical mechanical arm attached to the patient resting surface at one end and to a ceiling at the other end in case when the firm surface used for locking the system is a ceiling, and wherein a mechanical attachment device is provided at the ceiling end of the detachable vertical mechanical arm for locking purpose.

17. The method according to claim 12, wherein the method further comprises the step of transforming the patient transfer system into a wheelchair for easy maneuvering, and wherein the patient transfer system is transformed into wheelchair by elevating the head resting section of a mattress provided in the system by 90 degrees and lowering the leg and feet resting section by 90 degrees and subsequently elevating the feet resting section by 90 degrees.

* * * * *